US010577219B2

(12) United States Patent
Ifland et al.

(10) Patent No.: US 10,577,219 B2
(45) Date of Patent: Mar. 3, 2020

(54) METHOD, PROGRAM AND MOBILE DEVICE FOR CONTROLLING AN ELEVATOR SYSTEM

(71) Applicant: Otis Elevator Company, Farmington, CT (US)

(72) Inventors: Maren Ifland, Berlin (DE); Donald F. Cominelli, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 281 days.

(21) Appl. No.: 15/487,152

(22) Filed: Apr. 13, 2017

(65) Prior Publication Data

US 2017/0297862 A1 Oct. 19, 2017

(30) Foreign Application Priority Data

Apr. 15, 2016 (EP) ..... 16165574

(51) Int. Cl.
*B66B 1/34* (2006.01)
*B66B 1/46* (2006.01)

(52) U.S. Cl.
CPC ..... *B66B 1/3461* (2013.01); *B66B 1/46* (2013.01); *B66B 2201/4653* (2013.01)

(58) Field of Classification Search
USPC ..... 187/247
See application file for complete search history.

(56) References Cited

U.S. PATENT DOCUMENTS 5,485,897 A * 1/1996 Matsumoto ..... B66B 3/008 187/395
5,554,832 A * 9/1996 Lumme ..... B66B 1/468 187/380
5,736,692 A * 4/1998 Lumme ..... B66B 1/468 187/247
5,952,626 A 9/1999 Zaharia
5,964,319 A * 10/1999 Weingarden ..... B66B 13/143 187/314
6,109,396 A 8/2000 Sirag et al.
6,425,460 B2 7/2002 Schuster
6,481,536 B2 11/2002 Pfeffer
6,828,918 B2 * 12/2004 Bowman ..... G06F 1/163 340/4.1

(Continued)

FOREIGN PATENT DOCUMENTS

CN 101238057 A 8/2008
CN 204022209 U 12/2014

(Continued)

OTHER PUBLICATIONS

European Search Report for application for EP 16165574.1, dated Nov. 14, 2016, 7 pages.

(Continued)

*Primary Examiner* — Christopher Uhlir
(74) *Attorney, Agent, or Firm* — Cantor Colburn LLP

(57) ABSTRACT

A method of controlling an elevator system (2) comprising at least one elevator car (6), which is configured for travelling between a plurality of landings (8), comprises the steps of: displaying a hold button (26) on a mobile device (20) if the at least one elevator car (6) has stopped at a landing (8) and holding the elevator car (6) at the current landing (8) if the hold button (26) is operated.

16 Claims, 3 Drawing Sheets

(56) References Cited

U.S. PATENT DOCUMENTS

| | | | | |
|---|---|---|---|---|
| 6,868,945 | B2 | 3/2005 | Schuster et al. | |
| 6,948,592 | B2 * | 9/2005 | Kavounas | A61N 1/39 187/384 |
| 6,986,408 | B2 | 1/2006 | Takeuchi | |
| 7,353,915 | B2 | 4/2008 | Zaharia et al. | |
| 7,377,364 | B2 | 5/2008 | Tyni et al. | |
| 7,426,981 | B2 | 9/2008 | Bacellar et al. | |
| 7,500,544 | B2 | 3/2009 | Hakala et al. | |
| 7,552,800 | B2 | 6/2009 | Puskala et al. | |
| 7,610,995 | B2 | 11/2009 | Ylinen et al. | |
| 7,711,565 | B1 * | 5/2010 | Gazdzinski | B66B 3/00 187/396 |
| 8,047,333 | B2 | 11/2011 | Finschi | |
| 8,151,942 | B2 | 4/2012 | Rusanen et al. | |
| 9,957,132 | B2 * | 5/2018 | Berryhill | B66B 1/468 |
| 10,273,118 | B2 * | 4/2019 | Parviainen | B66B 1/468 |
| 2005/0103577 | A1 * | 5/2005 | Warner | B66B 13/26 187/317 |
| 2007/0238449 | A1 * | 10/2007 | Park | H04M 1/663 455/417 |
| 2013/0153339 | A1 | 6/2013 | Sarjanen | |
| 2014/0339023 | A1 | 11/2014 | Friedli | |
| 2015/0321881 | A1 | 11/2015 | Salmikuukka et al. | |
| 2018/0127234 | A1 * | 5/2018 | Lofberg | B66B 1/463 |

FOREIGN PATENT DOCUMENTS

| | | | |
|---|---|---|---|
| CN | 104326336 | A | 2/2015 |
| JP | 2003192244 | A | 7/2003 |
| JP | 2014136624 | A | 7/2014 |
| WO | 2006011876 | A1 | 2/2006 |
| WO | 2006114877 | A1 | 11/2006 |
| WO | 2008116963 | A1 | 10/2008 |
| WO | 2015075304 | A1 | 5/2015 |

OTHER PUBLICATIONS

Lu, Vanessa, "Smart elevators make up and down buttons obsolete", aavailable at: https://www.thestar.com/business/2015/04/03/smart-elevators-make-up-and-down-buttons-obsolete.html, Apr. 3, 2015, 2pgs.

Svensson, Eric "How to make an app for remote controlling an elevator (part 1)", EVO things, available at: http://evothings.com/how-to-make-an-app-for-remote-controlling-an-elevator-part-1/, Oct. 9, 2014, 4pgs.

* cited by examiner

METHOD, PROGRAM AND MOBILE DEVICE FOR CONTROLLING AN ELEVATOR SYSTEM

PRIORITY

This application claims priority to European Patent Application No. 16165574.1, filed 15 Apr. 2016, and all the benefits accruing therefrom under 35 U.S.C. § 119, the contents of which in its entirety are herein incorporated by reference.

BACKGROUND

The invention is related to a method, a program and a mobile device for controlling an elevator system. The invention is further related to an elevator system, which may be controlled using such a method, such a program and/or such a mobile device.

In an elevator system, a passenger intending to use the elevator system usually enters a service call for causing an elevator car to move to a boarding landing, typically on the floor on which the passenger is currently residing. After the elevator car has reached said boarding landing, the landing doors and the car doors of the elevator car open for a predetermined period of time ("door open time") for allowing the passenger(s) to enter the elevator car. In the following, the landing doors and the car doors a commonly referred to as "doors".

Service calls may be entered by means of stationary devices, which usually are arranged close to the landing doors, as well as by means of mobile devices, e.g. smartphones, carried by the persons authorized to use the elevator system.

In particular when a passenger uses a mobile device for entering his service call, there is some risk that he does not manage to reach the boarding landing and enter the elevator car while the doors are open. As a result, the doors will close, the elevator car may move to another floor and the passenger needs to make another service call and to wait for an elevator car to reach his boarding landing again.

It therefore would be beneficial to allow a passenger, who intends to enter an elevator car at a boarding landing, but needs additional time for approaching the boarding landing, to prevent the doors from closing and to hold the elevator car at his boarding landing.

SUMMARY

According to an exemplary embodiment of the invention, a method of controlling an elevator system comprising at least one elevator car, which is configured for traveling between a plurality of landings, includes the step of displaying a hold button on a mobile device if the at least one elevator car has stopped at a landing. The hold button in particular may be displayed as soon as the landing doors are open or are going to open. The method further includes the step of holding the elevator car at the landing in case the hold button is operated. It may further include preventing the landing doors and the elevator car doors from closing.

Exemplary embodiments of the invention further include a computer program for controlling an elevator system, the computer program being configured for executing a method according to an exemplary embodiment of the invention when run on a computer.

Exemplary embodiments of the invention further include a mobile device, in particular a smartphone, which is configured for running such computer program, and an elevator system, which is configured for being controlled by such a mobile device.

Exemplary embodiments of the invention allow a passenger, in particular a passenger who is positioned in some distance from the desired boarding landing and who needs additional time for approaching the boarding landing, to hold the elevator car at the boarding landing. It in particular may allow to prevent the doors from closing. As a result, the elevator car will wait for the passenger to arrive at his desired boarding landing and the passenger may enter the elevator car and start the desired elevator ride without delay. As a result, the comfort and convenience for the passengers using the elevator system are enhanced.

BRIEF DESCRIPTION OF THE DRAWINGS

Exemplary embodiments of the invention will be described in more detail with respect to the enclosed figures.

DETAILED DESCRIPTION

Figure 1:
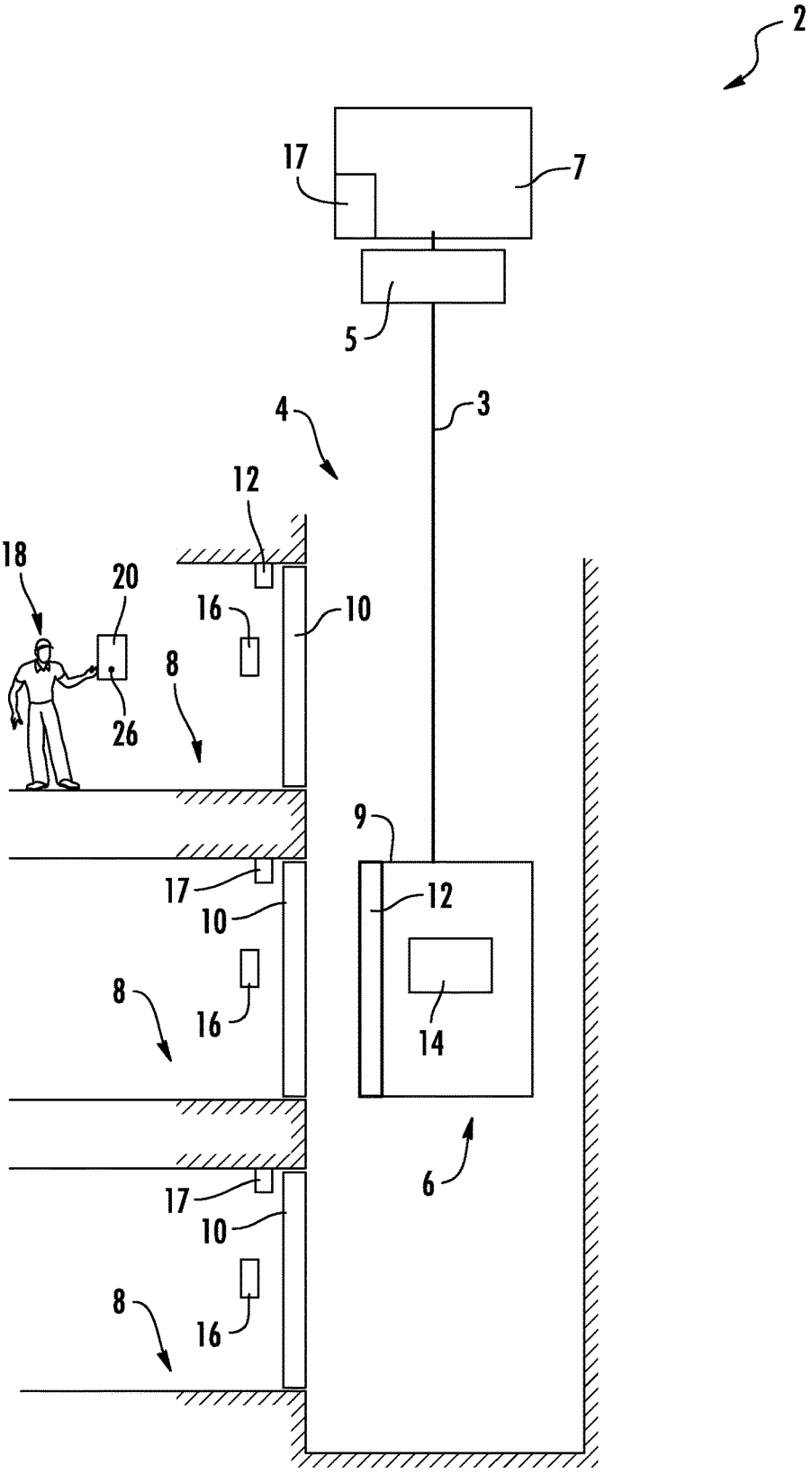
FIG. 1 depicts an elevator system according to an exemplary embodiment of the invention.

FIG. 1 depicts an elevator system 2 according to an exemplary embodiment of the invention.

The elevator system 2 includes an elevator car 6 which is movably suspended within a hoistway 4 by means of a tension member 3. The tension member 3, for example a rope or belt, is connected to an elevator drive 5, which is configured for driving the tension member 3 in order to move the elevator car 6 along the height of the hoistway 4 between a plurality of landings 8 located on different floors.

Each landing 8 is provided with a landing door 10, and the elevator car 6 is provided with a corresponding elevator car door 12 for allowing passengers to transfer between a landing 8 and the interior of the elevator car 6 when the elevator car 6 is positioned at the respective landing 8.

The exemplary embodiment shown in FIG. 1 uses a 1:1 roping for suspending the elevator car 6. The skilled person, however, easily understands that the type of the roping is not essential for the invention and that different kinds of roping, e.g. a 2:1 roping or none at all, may be used as well. The elevator system 2 may use a counterweight (not shown) or not. The elevator drive 5 may be any form of drive used in the art, e.g. a traction drive or a hydraulic drive. The elevator system 2 may have a machine room or may be a machine room-less elevator system.

The elevator drive 5 is controlled by an elevator control unit 7 for moving the elevator car 6 between the different landings 8.

Input to the control unit 7 may be provided via an elevator car control panel 14 provided inside the elevator car 6 and landing control panels 16, which are provided close to the landing doors 10 on each landing 8.

The elevator car control panel 14 and the landing control panels 16 may be connected to the elevator control unit 7 by means of electrical lines, which are not shown in FIG. 1, in particular an electric bus, or by means of wireless connections.

Alternatively or additionally, commands may be input to the elevator control unit 7 via mobile devices 20, e.g. smartphones, carried by the passengers 18. In this case, the elevator control unit 7 may be provided with at least one communication unit 17, which is configured for indirectly (including, but not limited to, via the Internet or a cellular network) or directly (including, but not limited to via WiFi, Bluetooth, or other known wireless communication methods, such as 1G, 2G (GSM), 3G, 4G (LTE), and future generations of cellar data communications) wirelessly communicating with the mobile device(s) 20.

Alternatively or additionally, communication units 17 may be provided at each landing 8 for communicating with mobile devices 20 being present on a floor on which a landing 8 is located or being present within a predetermined region around a respective landing 8. The communication units 17 in particular may be integrated with the landing control panels 16.

Figure 2:
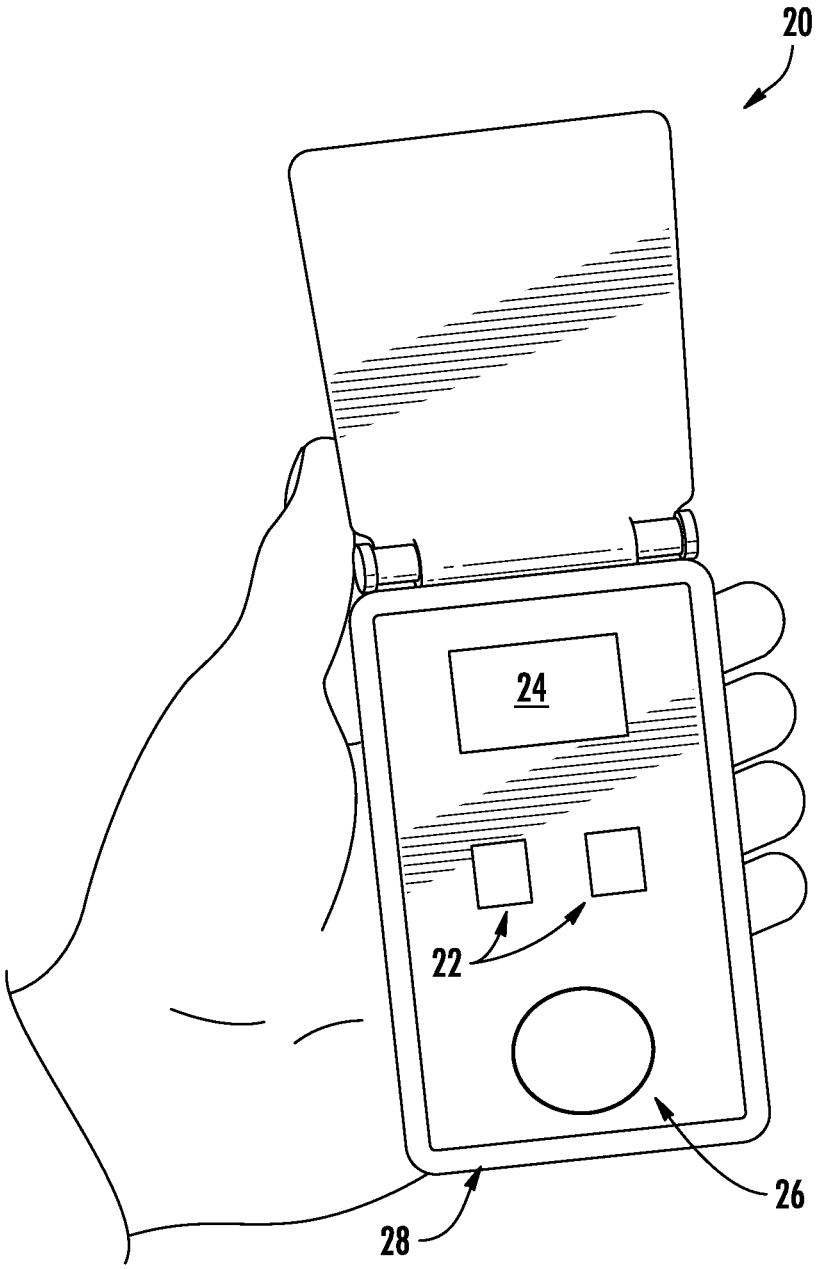
FIG. 2 depicts an exemplary embodiment of a mobile device according to an exemplary embodiment of the invention.

An exemplary embodiment of a mobile device 20, which in particular may be, but is not restricted to, a smartphone running appropriate software ("App"), is shown in FIG. 2.

The mobile device 20 in particular comprises or displays (e.g. on a touchscreen 28) control buttons 22, which are configured for entering service calls to be delivered to the elevator control unit 7.

The mobile device 20 may further comprise a display or display area 24, which is configured for displaying information about the current status of the elevator system 2, such as an indication of the elevator car 6 assigned to the passenger 18 and/or the floor number corresponding to the landing 8 at which said elevator car 6 is currently located.

The landing 8 on which the passenger 10 is currently residing may be determined by means of GPS, WiFi, bluteooth, transceivers and/or RFID sensors provided at each landing 8, in particular at the respective landing door 10. In one embodiment, any type of known technology capable of determining location and/or proximity may be utilized. Alternatively, the mobile device 20 may ask the passenger 18 what floor he is currently on. As soon as an elevator car 6 is positioned at a landing 8 on the same floor as the passenger 18 or at a landing 8 within a predetermined region around the passenger's 18 current location, and the landing doors 10 as well as the elevator car doors 12 have been opened or are going to open, an elevator car hold button 26 is displayed on the mobile device 20, in particular on a touchscreen 28 of the passenger's 18 mobile device 20.

In an alternative embodiment, the position of each elevator car 6 in the building is displayed, and for each elevator car 6 currently stopping at a landing 10, a hold button 28 is displayed on the mobile device 20. Thus, potentially a hold button 28 is displayed for every elevator car 6 allowing the passenger 18 to hold any elevator car 6 irrespectively of the landings 8 he and the elevator car 6 are currently residing on.

In one embodiment, the elevator car hold button 26 may be displayed before the landing doors 10 and/or the elevator car doors 12 have been opened.

By operating the hold button 26 (e.g by touching or pressing the hold button 26 on a display like touchscreen 28), the passenger 18 may hold the elevator car 6 at its current landing 8 for a longer time than usual. This may include preventing the landing doors 10 and the elevator car doors 12 from closing.

According to an exemplary embodiment, the elevator car 6 is held for a predetermined amount of time ("holding time"), e.g. ten seconds, after the hold button 26 has been operated, and the hold button 26 vanishes from the touchscreen 28, as soon as it has been operated. In one embodiment, the elevator hold time may be greater than or less than 10 seconds. In one embodiment, the hold button 26 remains on the screen or otherwise accessible to the passenger even after it has been pressed.

The hold button 26 may appear again after a predetermined period of time ("no-show time"), which may be shorter than the holding time in order to allow the passenger 18 to extend the holding time by pressing the hold button 26 again before the current holding time period expires.

In some embodiments, the holding time may get shorter each time the passenger 18 hits the button 26. I.e., when the hold button 26 appears and is pushed for the first time, the elevator car 6 is held for a first amount of time, e.g. 20 seconds. When the hold button 26 appears again and is pushed for the second time, the elevator car 6 is held further for a second amount of time, the second amount of time being shorter than the first amount of time, e.g. 15 or 10 seconds. This procedure may continue until a maximum holding time assigned to the passenger's mobile device 20 is reached.

A method of controlling an elevator system according to an exemplary embodiment of the invention is described in the following with reference to FIG. 3:

In a first step 100 it is checked whether the passenger 18 has entered an elevator service call to travel from a boarding landing 8 in upward direction or in downward direction to another landing 8. An elevator service call may be any of a hall call or a destination call. When entering a hall call, the passenger only informs the elevator system that he intends to travel from the boarding landing in upward direction or in downward direction. When entering a destination call the passenger informs the elevator system that he intends from the boarding landing to a specific destination landing located on another floor.

In case the passenger 18 has entered an elevator service call, the elevator control unit 7 dispatches the passenger's 18 service call by sending am elevator car 6 to the passenger's 18 boarding landing 8. The method illustrated in FIG. 3 waits in step 120 until an elevator car 6 has arrived at the passenger's 18 boarding landing 8.

After an elevator car 6 has arrived at the passenger's 18 boarding landing 8, a message indicating the arrival of the elevator car 6 is displayed on the display area 24 of the passenger's 18 mobile device 20 (step 130).

In the following step 140 the method may wait until the landing doors 10 and the elevator car door 12 have been opened. In an alternative embodiment, the elevator car hold button 26 may be displayed even before the landing doors 10 and/or the elevator car doors 12 have been opened. A hold button 26 is displayed on the passenger's 18 mobile device 20, in case there is no further demand for the elevator car 6 or the passenger 18 has sufficient rights for holding the elevator car 6 despite a further demand. For example the procedure checks whether the passenger (or the passenger's mobile device 20) has a sufficiently high privilege level to hold the elevator car 6 at the boarding landing despite further demands exist for the elevator car 6.

Different privilege levels may in particular include:

Level 0: Holding not allowed if another demand exists.

Level 1: Holding not allowed if more than M (M>1) demands exist.

Level 2: Holding allowed N times or for max. n seconds if another demand exists.

Level 3: Unlimited holding allowed even when one or more other demands exist.

Figure 3:
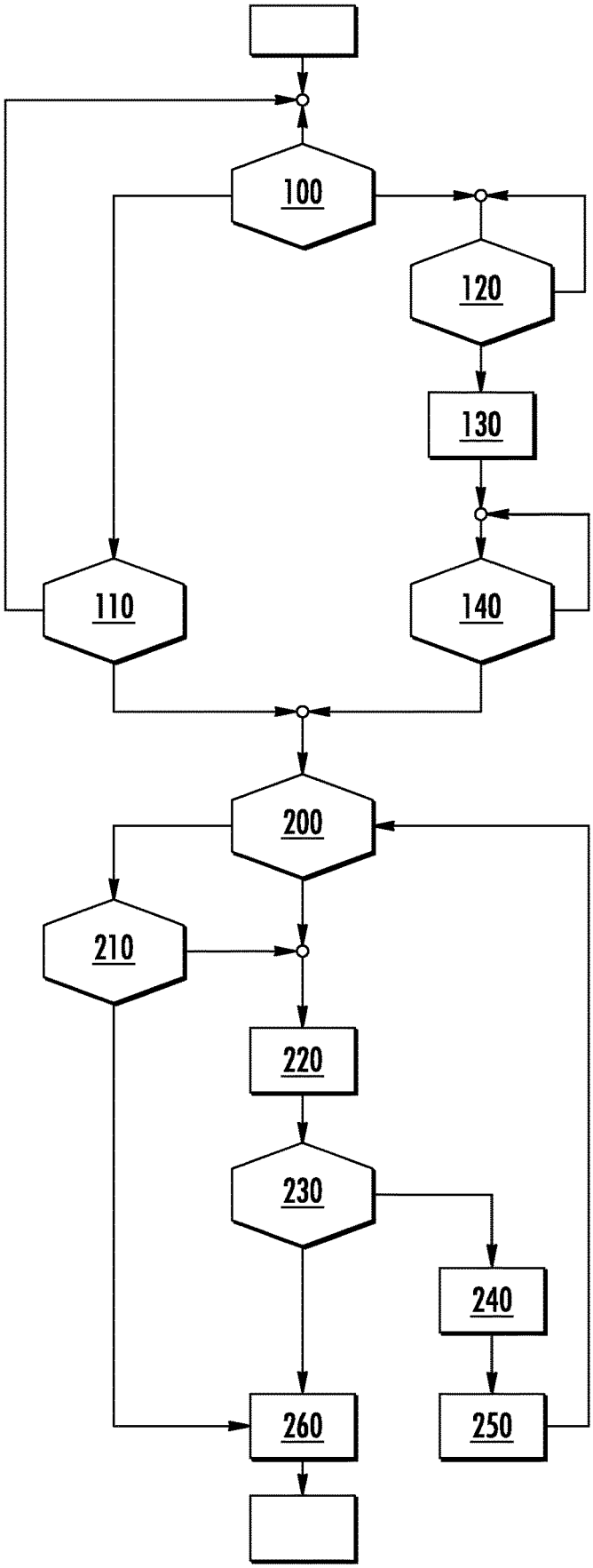
FIG. 3 depicts a flow-diagram illustrating a method of controlling an elevator system according to an exemplary embodiment of the invention.

The method illustrated in FIG. 3 allows to display the hold button 26 on a passenger's 18 mobile device 20 also in cases where the passenger 18 has not entered a service call before. This is an optional embodiment and is illustrated in FIG. 3 in the path from step 100 via step 110 to step 200. For example, the hold button 26 may be displayed on a passenger's mobile device 20 in case the elevator car 6 (or any useable elevator car 6 in elevator systems with more than one elevator car 6) stops at a landing 8 located on the same floor, or located within a predetermined region around the same floor, as the passenger's current position. For this functionality to work, the system needs to determine the passenger's 18 current location/landing 10 as described in more detail above. It may happen that an elevator car 6 has to stop at such landing 8 for other reasons, e.g. to let other passengers depart at that landing. Showing the hold button 26 allows the passenger to hold the elevator car 6 for some time at the landing 8 at short notice, without sending a service call before.

For example, the procedure may proceed as follows: In step 110 it is checked whether an elevator car 6 waits at a landing 8 on the same floor a the passenger's 18 current location, or at a landing 8 within a predetermined region around the passenger's 18 current location (e.g. at a neighboring floor).

When an elevator car 6 is waiting at a landing 8 on the same floor as the passenger's 18 current location, or at a landing 8 within a predetermined region around the passenger's 18 current location (step 110), the method checks whether there exists another demand for the respective elevator car 6 (step 200).

Step 200, and the following steps 210 to 260 apply in the same way, irrespective of whether the passenger 18 has entered a service call (i.e. following steps 100 to 140), or the passenger 18 has not entered a service call before (i.e. following steps 100 to 110). Therefore, these steps are described only once.

In case another demand exists, the elevator system 2 checks in step 210 whether the passenger 18 has the right to hold the elevator car 6 despite the existence of an alternative demand. Such right may be defined by the passenger's privilege level as it has been described before.

In case the passenger 18, i.e. his mobile device 20, has such right, or in case no alternative demand exists, the elevator system 2 continues with showing the hold button 26 on the mobile device 20 (step 220) and checking in step 230 whether the passenger 18 has operated said hold button 26.

In case the passenger 18 has operated the hold button 26 displayed on the mobile device 20, the doors 10,12 are held open for a predetermined amount of time ("holding time"), e.g. for ten seconds, and the elevator car 6 does not move from its current landing 8 (step 250). Optionally, the hold button 26 may disappear on the display of the mobile device 20 after it has been operated, as indicated in step 240.

After said holding time has expired, the method returns to step 200 checking again whether there exists another demand for the respective elevator car 6.

If the passenger 18 (his mobile device 20) does not have the right to hold the elevator car 6 in case an alternative demand is present, or in case the passenger 18 does not operate the hold button 26, the landing doors 10 and the elevator car doors 12 are closed and the elevator car 16 is allowed to move to a landing 8 on another floor (step 260).

After the elevator car 6 has reached another landing 8 or after a new service call has been entered, the method starts all over again with step 100.

While the elevator system 2, which is shown in FIG. 1 and which has been described with reference to said figure, comprises only a single elevator car 6, the skilled person easily understands that exemplary embodiments of the invention may also be employed in elevator systems 2 comprising a plurality of elevator cars 6.

In such cases the number(s) of the available elevator car(s) 6, if any, (step 110) may be displayed as well.

A number of optional features are set out in the following. These features may be realized in particular embodiments, alone or in combination with any of the other features.

In an embodiment the elevator car may be held at the current floor for a predetermined amount of holding time after the hold button has been operated. This allows a passenger to reach the elevator car without continuously operating (e.g. touching or pressing) the hold button. Holding the elevator car may include preventing the landing doors and the car doors from closing.

In an embodiment the method may further include the steps of checking whether a demand for the elevator car exists, and of allowing the landing doors and the car doors to close and the elevator car to leave the current floor, if a demand for the elevator car exists. This prevents the elevator system from being blocked by a passenger by operating the hold button.

In an embodiment the method may further include the step of checking rights assigned to the passenger's mobile device (e.g. checking a privilege level assigned to the passenger/the passenger's mobile device) and holding the elevator car at the current landing if the rights allow to hold the elevator car even if there exists a demand. This allows special "privileged" passengers ("VIPs") to hold the elevator car even in case another demand for the elevator car exists.

In an embodiment the method may allow the passenger to hold the elevator car for a maximum holding time, or less. This prevents the elevator system from being blocked by a passenger by continuously or repeatedly operating the hold button.

In an embodiment an individual maximum holding time may be assigned to the mobile device. This allows to assign different maximum holding times to different passengers/mobile devices. More privileged passengers may be provided with longer maximum holding times than less privileged passengers. The length of the maximum holding time may further depend on the spatial distance of the passenger/mobile device from the next landing area on his floor, or on neighboring floors.

In an embodiment the holding time may get shorter each time the passenger hits the button, i.e., when the hold button appears and is pushed for the first time, the elevator car is held for a first amount of time, e.g. 20 seconds. When the hold button appears again and is pushed for the second time, the elevator car is held further for a second amount of time, the second amount of time being shorter than the first amount of time, e.g. 15 or 10 seconds. This procedure may continue until the individual maximum holding time assigned to the passenger's mobile device is reached.

In an embodiment the method may include the step of making the hold button to disappear after it has been operated. This avoids the passenger from being confused by realizing a hold button which has no function. According to this embodiment the passenger may be sure that he may hold the elevator car when the hold button is displayed.

In an embodiment the method may include the step of displaying the hold button again after is as not been shown for a predetermined amount of time ("no-show time"). This allows the passenger to extend the holding time by operating the hold button again. In an embodiment the no-show time may be shorter than the holding time allowing the passenger to extend the holding time before the doors start to close.

In an embodiment the method may further comprise displaying on the mobile device an indication for identifying the held elevator car and/or an indication of the boarding landing at which the elevator car is held. This provides the passenger with additional information about the current operational status of the elevator system. It in particular prevents the passenger from mistakenly holding an elevator car he does not intend to use.

In an embodiment the elevator system may be configured for wirelessly communicating with the at least one mobile device, in particular via Bluetooth, WLAN and/or mobile radio communication in particular including 1G, 2G (GSM), 3G, 4G (LTE), and future generations of cellar data communications. This allows a convenient and reliable communication between the elevator system and the at least one mobile device.

In an embodiment the elevator system may be configured for communicating the hold button only to mobile devices which are located on the same floor as the landing at which at least one elevator car has stopped, within a predetermined region around said landing, and the landing doors and the car doors are open (e.g. for allowing other passengers to leave the elevator car). This feature is helpful to prevent passengers from holding elevator cars at floors they are not residing on, particularly in embodiments where the passenger are given the chance to hold the elevator car at a landing without having entered a service call before. This enhances the operational efficiency of the elevator system. In case the passenger has entered a service call before, the hold button will usually be communicated to the mobile device from which the service call has been entered, in case the at least one elevator car has stopped at the boarding landing.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the claims.

REFERENCES

2 elevator system
3 tension member
4 hoistway
5 drive
6 elevator car
7 elevator control unit
8 landing
9 ceiling of the elevator car
10 landing door
12 elevator car door
14 elevator car control panel
16 landing control panel
18 passenger
20 mobile device
22 control button
24 display area
26 hold button
28 touchscreen

What is claimed is:

1. Method of controlling an elevator system comprising an elevator car which is configured for travelling between a plurality of landings, wherein a landing of the plurality of landings is provided with a landing door, and the elevator car is provided with an elevator car door for allowing passengers to transfer between the landing and an interior of the elevator car; and wherein the method comprises:

determining a location of a passenger carrying a mobile device;

displaying a hold button on a mobile device only when both (i) the elevator car has stopped at the landing of a floor corresponding to the location of the passenger and (ii) the landing door and the elevator car door have been opened or are going to open; and holding the elevator car at the landing in response to the hold button being operated.

2. Method of controlling an elevator system according to claim 1, wherein the elevator car is held at the landing for a predetermined amount of holding time after the hold button has been operated.

3. Method of controlling an elevator system according to claim 1, further including checking whether there exists a demand for the elevator car and allowing the landing door and the elevator car door to close and the elevator car to leave the landing in response to an existing demand.

4. Method of controlling an elevator system according to claim 1, further including checking rights assigned to the mobile device and holding the elevator car at the landing according to the rights assigned to the mobile device allowing to hold the elevator car while there exists a demand for the elevator car.

5. Method of controlling an elevator system according to claim 1 further comprising allowing to hold the elevator car for a maximum holding time.

6. Method of controlling an elevator system according to claim 5, wherein an individual maximum holding time is assigned to the mobile device.

7. Method of controlling an elevator system according to claim 1 including making the hold button to disappear after it has been operated.

8. Method of controlling an elevator system according to claim 7 including displaying the hold button again after a predetermined amount of no-show time.

9. Method of controlling an elevator system according to claim 8, wherein the no-show time is shorter than a holding time.

10. Method of controlling an elevator system according to claim 1, further comprising displaying on the mobile device an indication for identifying at least one of the elevator car held on the landing and an indication of the landing at which the elevator car is held.

11. Computer program for controlling an elevator system, the computer program being configured for executing a method according to claim 1 when run on a computer.

12. Mobile device which is configured for running a program for executing a method according to claim 1.

13. Elevator system comprising an elevator car which is configured for travelling between a plurality of landings, wherein the elevator system is configured for communicating with at least one mobile device to carry out a method of controlling the elevator system according to claim 1.

14. Elevator system according to claim 13, which is configured for wirelessly communicating with the at least one mobile device.

15. Elevator system according to claim 13, which is configured for communicating the hold button only to mobile devices which are located on the same floor as the landing at which the elevator car has stopped, or to mobile devices which are located within a predetermined region around the landing at which the elevator car has stopped, or to a mobile device from which a service call has been received.

16. Method of controlling an elevator system according to claim 1 wherein determining the location of the passenger carrying the mobile device comprises asking the passenger where the passenger is located.

* * * * *